US009662523B2

(12) United States Patent
Ji et al.

(10) Patent No.: US 9,662,523 B2
(45) Date of Patent: May 30, 2017

(54) METALLIC OXYSALT FIRE EXTINGUISHING COMPOSITION

(71) Applicant: XI'AN WESTPEACE FIRE TECHNOLOGY CO., LTD., Xi'an, Shaanxi (CN)

(72) Inventors: Tao Ji, Shaanxi (CN); Tao Wei, Shaanxi (CN); Wei Tian, Shaanxi (CN); Shengxin Liu, Shaanxi (CN)

(73) Assignee: XI'AN WESTPEACE FIRE TECHNOLOGY CO., LTD., Xi'an, Shaanxi (CN)

( * ) Notice: Subject to any disclaimer, the term of this patent is extended or adjusted under 35 U.S.C. 154(b) by 0 days.

(21) Appl. No.: 14/431,306

(22) PCT Filed: Sep. 18, 2013

(86) PCT No.: PCT/CN2013/083814
§ 371 (c)(1),
(2) Date: Mar. 26, 2015

(87) PCT Pub. No.: WO2014/048272
PCT Pub. Date: Apr. 3, 2014

(65) Prior Publication Data

US 2015/0251036 A1 Sep. 10, 2015

(30) Foreign Application Priority Data

Sep. 27, 2012 (CN) ..... 2012 1 0367952

(51) Int. Cl.
*A62D 1/06* (2006.01)

(52) U.S. Cl.
CPC ..... *A62D 1/06* (2013.01)

(58) Field of Classification Search
CPC ..... A62D 1/0007; A62D 1/06
See application file for complete search history.

(56) References Cited

U.S. PATENT DOCUMENTS

| | | | | |
|---|---|---|---|---|
| 2010/0179259 | A1* | 7/2010 | Guo | A62C 3/16 524/105 |
| 2013/0181157 | A1 | 7/2013 | Guo et al. | |
| 2013/0181158 | A1* | 7/2013 | Guo et al. | 252/2 |
| 2013/0221264 | A1 | 8/2013 | Guo et al. | |

FOREIGN PATENT DOCUMENTS

| | | | |
|---|---|---|---|
| CA | 2811458 | A1 | 3/2012 |
| CN | 101085400 | A | 12/2007 |
| EP | 2168637 | A1 | 3/2010 |
| EP | 2476466 | A1 | 7/2012 |
| WO | WO 2012034494 | A1 * | 3/2012 |

OTHER PUBLICATIONS

US 5,695,691, 12/1997, McLaughlin et al. (withdrawn)
Extended European Search Report issued in corresponding European Patent Application No. 13842486.6 dated May 17, 2016 (6 pages).

* cited by examiner

*Primary Examiner* — Peter F Godenschwager
(74) *Attorney, Agent, or Firm* — Kilyk & Bowersox, P.L.L.C.

(57) ABSTRACT

Disclosed in the present invention is a metallic oxysalt fire extinguishing composition; the fire extinguishing composition comprises a metallic oxysalt compound and a flame-retardant extinguishing component, their proportion being respectively as follows: 30%-95% of the metallic oxysalt compound and 5%-70% of the flame-retardant extinguishing component. A pyrotechnic composition is used as the heat source and the power source of the fire extinguishing composition in the present invention, by igniting the pyrotechnic composition, the fire extinguishing composition being heated and subjected to a decomposition reaction by using high temperature generated by means of combustion of the pyrotechnic composition, large quantities of substances capable of extinguishing fire being generated, and the fire extinguishing substances along with the pyrotechnic composition being ejected from the nozzle of a fire extinguishing apparatus, thus achieving the purpose of extinguishing fire. The fire extinguishing composition of the present invention is simple in composition, stable in performance, easy to store for a long time, non-toxic, and has excellent environment-friendly properties.

7 Claims, No Drawings

METALLIC OXYSALT FIRE EXTINGUISHING COMPOSITION

TECHNICAL FIELD

The present invention belongs to the field of aerosol fire extinguishing techniques, specifically relates to a metallic oxysalt fire extinguishing composition.

BACKGROUND ART

Concerning the protection of the ozone layer, and phasing out the ozone-depleting substances, the notable Vienna Convention and the Montreal Protocol were signed successively by the main states around the world during 1985-1987. Under this background, the Halon fire extinguishing agents, which were disruptive to the ozone layer, were prohibited in the developed countries in Europe and America, and categorized as substances to be phased out in other countries. In 1992, the China's National Scheme On Phasing Out Ozone Depleting Substances were formulated in China. In the fire protection industry of China, the mission of phasing out Halon 1211 was achieved on Dec. 31, 2005; the production of Halon 1301 was entirely terminated from Jan. 1, 2006; the use of Halon was entirely terminated by the end of 2010. Therefore, in various countries, it has become one of the hot research issues to seek for substitute products for Halon fire extinguishing agents and substitute techniques, which are non-disruptive to the ozone layer of the atmosphere, highly efficient in extinguishing fire, nontoxic and harmless. Currently three categories of substitute products for Halons are widely being developed: haloalkanes, inert gases and aerosol fire extinguishing agents. The aerosol fire extinguishing agent is an extremely highly efficient novel fire extinguishing agent, which has an ozone depletion potential (ODP) of zero. It is nontoxic, harmless, and residual free; it has low price, and the investment demand for its manufacturing equipment is low. Under the urgent background of phasing out Halon, the aerosol fire extinguishing technique is intensively supported by the government, while it also fits the market demand; therefore it becomes one of the remarkable substitute techniques for Halons in the past ten-odd years.

The aerosol fire extinguishing agents, which are mainly divided into two types, S-type and K-type, are composed of oxidants, reductants, burning rate controllers and adhesives. The main fire extinguishing mechanisms of the aerosol fire extinguishing agents are: 1, heat absorption and cooling; 2, chemical inhibition; 3, suffocation; 4, insulation; wherein chemical inhibition is the main mechanism. Though the aerosol fire extinguishing agents are significantly advantageous in aspects like extinguishing efficiency, storage status, construction cost, maintenance, toxicity, secondary damage, environmental friendliness, extinguishing concentration, etc., there are shortcomings in their application, due to the large-scale emission of gas, active particles in the redox reaction, and the simultaneous heat release. In order to effectively decrease the temperature of the device and aerosol, and to prevent the secondary fire, adding a cooling system to the fire extinguishing device is required. Simple physical cooling leads to complicated and bulky structure of the device, complicated process flow and high cost; and due to the presence of the cooling system, large amount of active particles are inactivated, result in greatly degraded extinguishing performance. In addition, affected by the cooling performance, the nozzle temperature of the current aerosol fire extinguishing products is usually too high, which readily harms the operators.

SUMMARY OF INVENTION

To resolve the inherent defects of the fire extinguishing agent in the prior art, the present invention provides a metallic oxysalt fire extinguishing composition, which has high extinguishing efficacy, excellent safety performance, and high utilization ratio.

The solution to the problem in the present invention is:

A metallic oxysalt fire extinguishing composition, characterized in that, the fire extinguishing composition contains a metallic oxysalt compound and a flame-retardant extinguishing component. Their proportions are respectively as follow:

Metallic oxysalt compound 30%~95%

Flame-retardant extinguishing component 5%~70%

A pyrotechnic agent is used as the heat source and the power source of the fire extinguishing composition. By igniting the pyrotechnic agent, the composition is heated by the high temperature generated from the combustion of the pyrotechnic agent, and it is subjected to a decomposition reaction. A large amount of fire extinguishable substances are produced, and ejected out together with the pyrotechnic agents; thereby the target of fire extinguishing is achieved.

Further, the fire extinguishing composition contains an additive, and the mass percentage content of the additive is more than 0% to 10% or less. The addition amount of the performance additive is preferably 1%~6%, further preferably 1.5%~3%.

Further, the additive is one or more of polyvinyl alcohol, hydroxypropyl methyl cellulose, acetal adhesives, shellac, starch, dextrin, epoxy resin, graphite powder, talcum powder, stearate, preferably one or more of hydroxypropyl methyl cellulose, magnisium stearate, talcum powder.

Further, the mass percentage content of metallic oxysalt compounds in the fire extinguishing composition is 60%~95%.

In the present invention, the metallic oxysalt indicates a group of compounds, whose oxyacid root contains metal elements.

Further, the metallic oxysalt compound is one or more of tungstate, metatungstate, tungstophosphate, manganate, manganite, molybdate, phosphomolybdate, cobaltate, chromate, stannate, metaaluminate, cuprate, antimonate, titanate, zirconate, ferrite.

Further, the metallic oxysalt compound is one or more of a metallic oxyacid potassium salt, a metallic oxyacid sodium salt, a metallic oxyacid copper salt, a metallic oxyacid calcium salt, a metallic oxyacid manganous salt, a metallic oxyacid aluminium salt, a metallic oxyacid zinc salt, a metallic oxyacid magnesium salt, a metallic oxyacid nickel salt, a metallic oxyacid ferric salt, a metallic oxyacid ammonium salt, a metallic oxyacid lithium salt, a metallic oxyacid strontium salt.

Further, the flame-retardant component is one or more of inorganic flame retardants, halogen-based flame retardant, phosphorus-based flame retardants or nitrogen-based flame retardants; the mass percentage content of the flame-retardant components is 5%~35%.

Further, the components and their contents in the fire extinguishing composition are preferably as follow:

Metallic oxysalt compound 70%~90%

Flame-retardant extinguishing component 5%~25%

Additive 1%~6%

Further, the components and their contents in the fire extinguishing composition are preferably as follow:

Metallic oxysalt compounds 80%~90%

Flame-retardant extinguishing components 5%~15%

Additives 1~5%

The fire extinguishing composition of the present invention can be molded into spheres, sheets, stripes, blocks and honeycombs by processes such as pelleting, molding, extrusion, and may be subjected to a surface coating treatment. Hydroxypropyl methylcellulose is preferably added during the surface coating treatment. This surface coating agent can improve the surface smoothness of the composition system, enhance its strength and resistance to abrasion and vibration, thereby preventing the composition system from chalking, slagging and spilling out from the extinguisher during transport. To facilitate the molding process, graphite, talcum powder, stearate and the like can be appropriately added.

The pyrotechnic agent is used as the heat source and the power source of the fire extinguishing composition in the present invention. By igniting the pyrotechnic agent, the fire extinguishing composition heated by the high temperature generated from the combustion of the pyrotechnic agent is subjected to a decomposition reaction, which produces a large amount of fire extinguishable substances. The fire extinguishable substances, together with the pyrotechnic agents, are ejected out from the nozzle of the fire extinguishing device; thereby the target of fire extinguishing is achieved.

Comparing with the prior art, the advantages of the present invention are as follow:

1) In the circumstance of being heated at high temperature, the metallic oxysalt fire extinguishing composition of the present invention can rapidly undergo endothermic decomposition. The heat absorption in the decomposition can effectively and rapidly reduce the heat released by the combustion of the pyrotechnic agent, and greatly decrease the temperature of the extinguisher nozzle and the ejected substances; the complicated cooling system of the fire extinguishing device is omitted, while the risk of secondary fire is eliminated. A large amount of effective fire extinguishable substances, mainly liquid or solid particles, are released at the instant that the composition is heated; through the synergistic effect of various particles, the extinguishing time is greatly shortened.
2) A flame retardant can be added into the metallic oxysalt fire extinguishing composition of the present invention. Through the flame-retardant effect of the decomposition products of the flame retardant, the possibility of combustion source rekindling is reduced, while the extinguishing performance of the fire extinguishing agent is further enhanced.
3) The metallic oxysalt fire extinguishing composition of the present invention can be easily processed and molded, and it can be used alone or be used in combination with a physical coolant.
4) The metallic oxysalt fire extinguishing composition of the present invention is stable in performance, easy for long-term storage, non-toxic, and has excellent environmental friendly properties.

DESCRIPTION OF THE EMBODIMENTS

The fire extinguishing composition of the present invention is further described through the detailed examples below.

The fire extinguishing composition indicated above is added into a K-type thermal aerosol fire extinguishing device, meanwhile the commercially distributed S-type aerosol fire extinguishing agent or K-type aerosol fire extinguishing agent is added into the same fire extinguishing device. In detail:

Example 1

A 50 g sample of composition prepared with magnesium tungstate, monoammonium phosphate and potassium chloride is added into a fire extinguishing device which contains 50 g of K-type thermal aerosol generating agent. A test of extinguishing 93# petrol fire in an oil tray with area of 0.25 $m^2$ is performed. The test result is shown in Table 1.

Example 2

A 50 g sample of composition prepared with ammonium molybdate, strontium chromate and cyanurotriamide is added into a fire extinguishing device which contains 50 g of K-type thermal aerosol generating agent. A test of extinguishing 93 # petrol fire in an oil tray with area of 0.25 $m^2$ is performed. The test result is shown in Table 1.

Example 3

A 50 g sample of composition prepared with lithium hexafluorostannate, magnesium tungstate and cyanurotriamide is added into a fire extinguishing device which contains 50 g of K-type thermal aerosol generating agent. A test of extinguishing 93# petrol fire in an oil tray with area of 0.25 $m^2$ is performed. The test result is shown in Table 1.

Example 4

A 50 g sample of composition prepared with sodium phosphomolybdate, sodium antimonate, monoammonium phosphate and cyanurotriamide is added into a fire extinguishing device which contains 50 g of K-type thermal aerosol generating agent. A test of extinguishing 93# petrol fire in an oil tray with area of 0.25 $m^2$ is performed. The test result is shown in Table 1.

Example 5

A 50 g sample of composition prepared with ammonium metatungstate, monoammonium phosphate and potassium chloride is added into a fire extinguishing device which contains 50 g of K-type thermal aerosol generating agent. A test of extinguishing 93# petrol fire in an oil tray with area of 0.25 $m^2$ is performed. The test result is shown in Table 1.

Example 6

A 50 g sample of composition prepared with strontium chromate, monoammonium phosphate and potassium chloride is added into a fire extinguishing device which contains 50 g of K-type thermal aerosol generating agent. A test of extinguishing 93# petrol fire in an oil tray with area of 0.25 $m^2$ is performed. The test result is shown in Table 1.

Example 7

A 50 g sample of composition prepared with sodium antimonate and ammonium metatungstate is added into a fire extinguishing device which contains 50 g of K-type thermal aerosol generating agent. A test of extinguishing 93# petrol fire in an oil tray with area of 0.25 $m^2$ is performed. The test result is shown in Table 1.

Comparative Example 1

A sample of fire extinguishing device which only contains 50 g of K-type thermal aerosol fire extinguishing agent is taken. A test of extinguishing 93# petrol fire in an oil tray with area of 0.25 $m^2$ is performed. The test result is shown in Table 1.

Comparative Example 2

A sample of fire extinguishing device which only contains 50 g of S-type thermal aerosol fire extinguishing agent is taken. A test of extinguishing 93# petrol fire in an oil tray with area of 0.25 $m^2$ is performed. The test result is shown in Table 1.

Comparative Example 3

A 50 g sample of composition prepared with monoammonium phosphate and potassium chloride is added into a fire extinguishing device which contains 50 g of K-type thermal aerosol generating agent. A test of extinguishing 93# petrol fire in an oil tray with area of 0.25 $m^2$ is performed. The test result is shown in Table 1.

After molding with the conventional preparation process, 50 g of the metallic oxysalt fire extinguishing composition of the present invention is added into a fire extinguishing device which contains 50 g of K-type thermal aerosol generating agent. The 8B fire extinguishing test is performed; see the regulation in section 6.3.2.1, GA86-2009 for the detailed test model. In the crossover test, three shots are applied in each group. In the comparative examples, 50 g of conventional K-type thermal aerosol fire extinguishing agent or S-type thermal aerosol fire extinguishing agent, and the coolant, are added into the fire extinguishing device. The fire extinguishing test is performed in the same condition. The results are shown in Table 1.

TABLE 1

Comparison of components and contrast of test results

| | Content (mass percent) of components in Examples | | | | | | | Comparative Examples | | |
|---|---|---|---|---|---|---|---|---|---|---|
| Ingredients | 1 | 2 | 3 | 4 | 5 | 6 | 7 | 1 | 2 | 3 |
| K-type fire extinguishing agent | | | | | | | | • | | |
| S-type fire extinguishing agent | | | | | | | | | • | |
| Magnesium tungstate | 66 | | 45 | | | | | | | |
| Ammonium molybdate | | 60 | | | | | | | | |
| Lithium hexafluoro-stannate | | | 50 | | | | | | | |
| Sodium antimonate | | | | 40 | | | 40 | | | |
| Ammonium metatungstate | | | | | 85 | | 60 | | | |
| Sodium phospho-molybdate | | | | 40 | | | | | | |

TABLE 1-continued

Comparison of components and contrast of test results

| | Content (mass percent) of components in Examples | | | | | | | Comparative Examples | | |
|---|---|---|---|---|---|---|---|---|---|---|
| Ingredients | 1 | 2 | 3 | 4 | 5 | 6 | 7 | 1 | 2 | 3 |
| Strontium chromate | | 30 | | | | 30 | | | | |
| Mono-ammonium phosphate | 17 | | | 6 | 5 | 28 | | | | 56 |
| Cyanuro-triamide | | 5 | 3 | 9 | | | | | | |
| Potassium chloride | 10 | | | | 3 | 32 | | | | 38 |
| Hydroxypropyl methyl cellulose | 4.5 | 3 | | 2.5 | 4.5 | 3 | | | | 3.5 |
| Magnisium stearate | 2.5 | | 2 | | 2.5 | 3 | | | | 2.5 |
| Talcum powder | | 2 | | 2.5 | | 4 | | | | |
| Test result | | | | | | | | | | |
| *Extinguishing status | ⅔ | A | A | A | A | A | A | N | N | N |

*Notes: ⅔ denotes that fire is extinguished in two of the three shots. A denotes that fire is extinguished in all the three shots. N denotes that fire is extinguished in none of the three shots.

The S, K-type extinguishing agents used in the Comparative Examples 1 to 3 in the table above are commercially available. From Table 1 it can be observed that all the metallic oxysalt fire extinguishing compositions of the present invention in Examples 1 to 6 can extinguish the fire in the oil tray test, therefore they are far more superior to the condition of Comparative Examples 1 to 3 in extinguishing efficiency. Besides, open flame at the nozzle presents in none of the Examples 1 to 6.

The above specific examples are merely exemplary, and various modifications and variations made by persons skilled in the art on the basis of the teaching by the examples of the present invention fall within the protection scope of the present invention. Those skilled in the art should understand that the above specific description is only for the purpose of explaining the present invention and are not intended to limit the present invention in its scope.

The invention claimed is:

1. A metallic oxysalt fire extinguishing composition, characterized in that the fire extinguishing composition contains a metallic oxysalt compound and a flame-retardant extinguishing component, wherein the proportions are respectively as follows:

Metallic oxysalt compound 60%~95%,

Flame-retardant extinguishing component 5%~35%;

the metallic oxysalt compound is one or more of a metallic oxyacid copper salt, a metallic oxyacid calcium salt, a metallic oxyacid aluminium salt, a metallic oxyacid magnesium salt, a metallic oxyacid nickel salt, a metallic oxyacid ferric salt, and a metallic oxyacid lithium salt;

a pyrotechnic agent in a fire extinguishing apparatus is used as a heat source and a power source of the fire extinguishing composition during the application of the fire extinguishing composition; by igniting the pyrotechnic agent, the fire extinguishing composition heated by the high temperature generated from the combustion of the pyrotechnic agent is subjected to a decomposition reaction, producing a large amount of fire extinguishable substances, which are ejected out together with the pyrotechnic agents to extinguish the fire.

2. The metallic oxysalt fire extinguishing composition according to claim 1, characterized in that the fire extinguishing composition further contains an additive in an amount of more than 0% to 10% or less by mass percentage.

3. The metallic oxysalt fire extinguishing composition according to claim 2, characterized in that the additive is one or more of polyvinyl alcohol, hydroxypropyl methyl cellulose, acetal adhesives, shellac, starch, dextrin, epoxy resin, graphite powder, talcum powder, and stearate.

4. The metallic oxysalt fire extinguishing composition according to claim 1, characterized in that the metallic oxysalt compound is one or more of tungstate, metatungstate, tungstophosphate, manganate, manganite, molybdate, phosphomolybdate, cobaltate, chromate, stannate, metaaluminate, cuprate, antimonate, titanate, zirconate, and ferrite.

5. The metallic oxysalt fire extinguishing composition according to claim 1, characterized in that the flame-retardant extinguishing component is one or more of inorganic flame retardants, halogen-based flame retardant, phosphorus-based flame retardants and nitrogen-based flame retardants.

6. The metallic oxysalt fire extinguishing composition according to claim 5, characterized in that the components and their contents in the fire extinguishing composition are as follows:

Metallic oxysalt compound 70%~90%,

Flame-retardant extinguishing component 5%~25%,

Additive 1%~6%.

7. The metallic oxysalt fire extinguishing composition according to claim 6, characterized in that the components and their contents of the fire extinguishing composition are as follows:

Metallic oxysalt compound 80%~90%,

Flame-retardant extinguishing component 5%~15%,

Additive 1%~6%.

* * * * *